United States Patent [19]

Verzilli et al.

[11] Patent Number: 4,630,337

[45] Date of Patent: Dec. 23, 1986

[54] APPARATUS FOR DOUBLING A FIBER WEB

[75] Inventors: Giuseppe Verzilli, Wiesendangen; Rene Schmid, Niederneunforn, both of Switzerland

[73] Assignee: Rieter Machine Works Limited, Winterthur, Switzerland

[21] Appl. No.: 656,673

[22] Filed: Oct. 1, 1984

[30] Foreign Application Priority Data

Oct. 10, 1983 [CH] Switzerland ..... 5507/83

[51] Int. Cl.[4] ..... D01H 5/00

[52] U.S. Cl. ..... 19/296; 19/157; 19/243

[58] Field of Search ..... 19/243, 296, 302, 150, 19/157, 288

[56] References Cited

U.S. PATENT DOCUMENTS

| | | | |
|---|---|---|---|
| 3,105,997 | 10/1963 | Mackie | 19/243 X |
| 3,128,506 | 4/1964 | Brandt | 19/243 X |
| 3,145,429 | 8/1964 | Resor | 19/157 |
| 3,216,064 | 11/1965 | Kates | 19/157 X |
| 3,224,181 | 12/1965 | Johnson . | |
| 3,327,356 | 6/1967 | Andreani | 19/243 |
| 3,394,436 | 7/1968 | Sumner | 19/243 |
| 3,432,890 | 3/1969 | Burnham et al. | 19/243 X |

FOREIGN PATENT DOCUMENTS

| | | |
|---|---|---|
| 836297 | 4/1976 | France . |
| 1225836 | 3/1971 | United Kingdom . |

*Primary Examiner*—Louis K. Rimrodt
*Assistant Examiner*—J. L. Olds
*Attorney, Agent, or Firm*—Werner W. Kleeman

[57] ABSTRACT

A ribbon lap unit contains support shafts for receiving and supporting a lap, a web transport means in the form of a web drafting mechanism, a web diverter, a diverter plate arrangement and a web collecting element. A web unrolled from the lap is fed through the web drafting mechanism and around the web diverter onto the diverter plate arrangement and thereafter onto the web collecting element. By means of the web diverter it is possible to arrange the diverter plate arrangement beneath the drafting mechanism. This, in turn, enables constructing a very compact machine.

19 Claims, 8 Drawing Figures

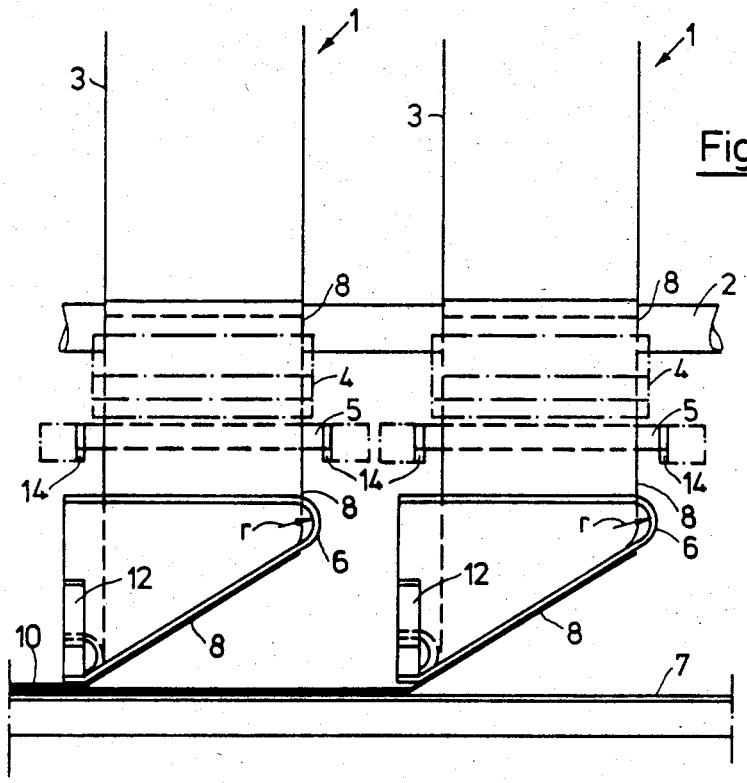
Fig. 3
Figuren 8
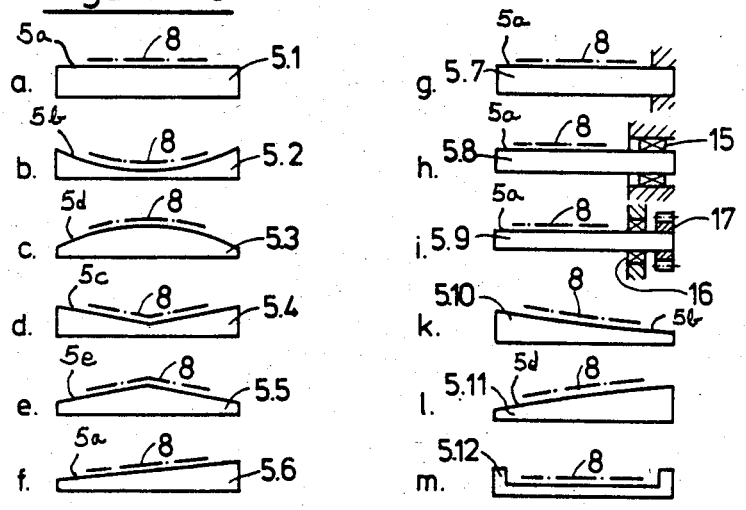

APPARATUS FOR DOUBLING A FIBER WEB

BACKGROUND OF THE INVENTION

The present invention relates to a new and improved construction of apparatus for doubling of fiber webs.

Generally speaking, the fiber web-doubling apparatus of the present development is of the type comprising web transport means, a web collecting or collector element, and a so-called diverter plate arrangement for deflecting or turning the web from the transport or conveying direction of the web transport means into the transport or conveying direction of the web collecting element.

Doubling, that is superposing fiber webs so as to form a new single web, serves for evening these webs with regard to length and to the blend of the staple fibers which form the web.

Apparatuses of the aforementioned type which serve for such doubling operations are primarily used on so-called ribbon lap machines which are commercially known from spinning machines. In such ribbon lap machines a plurality of laps arranged adjacent one another supply their respective fiber webs into a drafting mechanism where the web is drawn and is thereafter immediately guided over a so-called diverter plate arrangement.

By means of this diverter plate arrangement the drawn fiber webs are superposed so as to form a new fiber web composed of all of the drawn webs of the same machine.

Additionally, the apparatus can be used on so-called sliver lap machines which bring together a plurality of drawn fiber slivers into a web and double these individual web so as to form a new web.

Such a sliver lap machine has been disclosed in Swiss Pat. No. 375,640, granted Feb. 29, 1964 and the corresponding U.S. Pat. No. 3,128,506, granted Apr. 14, 1964. This sliver lap machine comprises fiber sliver drafting mechanisms arranged next to one another and to which there are delivered fiber slivers from sliver cans or the like.

The fiber slivers which are drawn in the drafting mechanisms are combined or amalgamated into a web and following each drafting mechanism are guided by means of a diverter plate arrangement on to a collecting surface for all of the webs. The diverter plate arrangement is arranged adjoining the drafting mechanism viewed with respect to the transport direction of the web. The individual webs, collected to form a new web, are guided to a wind-up apparatus for the formation of a lap.

The previously discussed ribbon lap machines have a construction resembling that of the sliver lap machines except that laps are used as the web feed in place of the sliver cans delivering fiber slivers. In other words, the individual drafting mechanisms do not draw fiber slivers, as is the case for the sliver lap machines, but webs delivered by the lap. The individual drawn webs are collected so as to form a new web in the same manner as in the sliver lap machines and are also guided to a wind-up apparatus for the formation of a lap. The laps of the ribbon lap machines thereafter serve as the feed or stock for the combing machines.

The described construction of the sliver lap machine, and also that of the ribbon lap machine, is afflicted with the drawback that due to the disposition of the diverter plate arrangement in front of the drafting mechanism, as viewed from the service side of the machine, leading in of the staple fiber slivers or lap ribbons, as the case may be, cannot be carried out unless the machine attendant or operator first guides the staple fiber slivers or the webs into the infeed rolls of the drafting mechanism from the back of the machine and thereafter seizes or catches at the front of the machine the webs delivered from the drafting mechanisms and guides them over the diverter plate arrangement.

SUMMARY OF THE INVENTION

Therefore, with the foregoing in mind it is a primary object of the present invention to provide a new and improved construction of an apparatus for doubling of fiber webs in a manner which is not afflicted with the aforementioned drawbacks and limitations of the prior art constructions.

Another and more specific object of the present invention aims at simplifying the aforementioned operating procedure which complicates starting-up of the machines.

Now in order to implement these and still further objects of the invention, which will become more readily apparent as the description proceeds, the fiber web-doubling apparatus of the present development is manifested by the features that a web diverter is provided between the web transport means and the diverter plate arrangement in such a manner that the diverter plate arrangement can be located beneath the web transport means.

Certain of the more notable advantages achieved by the present invention reside in the fact that due to the provision of the diverter plate arrangement underneath the drafting mechanism the machine is less wide or deep, so that the operator can carry out leading-in of the fiber slivers or webs also from the service side. Furthermore, primarily for the so-called ribbon lap machine there results the advantage that due to the possibility of servicing or operating upon the drafting mechanism from the front side of the machine the laps can be provided on the upper side of the machine, in contrast to the known prior art arrangement where the laps are located at the back of the machine.

By virtue of these measures the dimensions of the machine—with reference to the width or depth of the machine—are additionally quite appreciably reduced.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 3 illustrates the ribbon lap machine of FIG. 1, partially schematically depicted, and looking in the direction of the arrow III, in other words, viewed from the service or front side of the machine;

FIGS. 8*a* to 8*m* respectively depict different embodiments of a component or part which is important to the present invention.

DETAILED DESCRIPTION OF THE PREFERRED EMBODIMENTS

Figure 1:
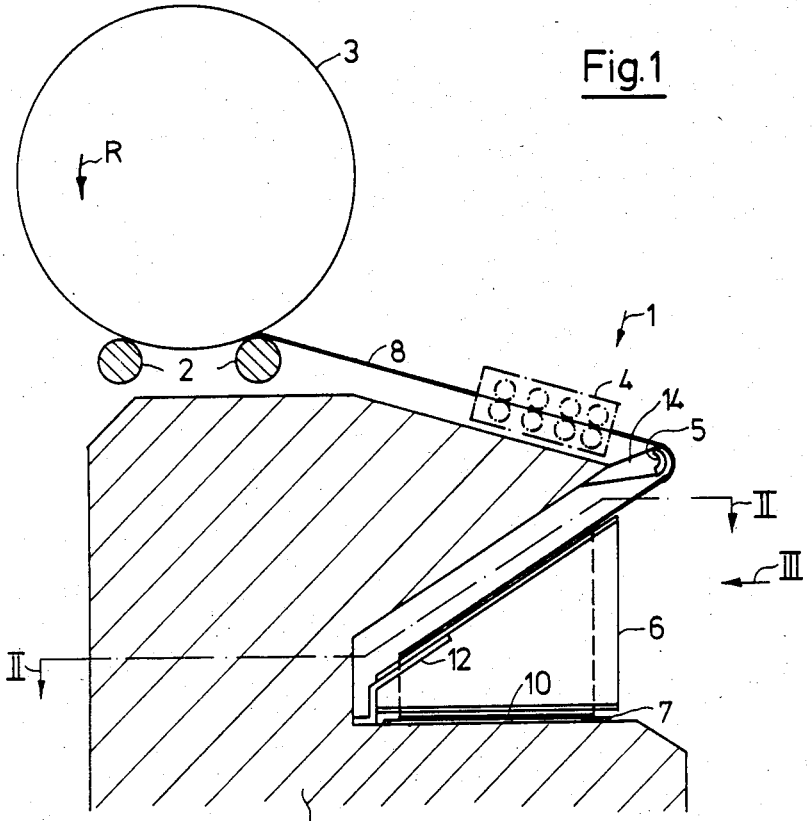
FIG. 1 illustrates partially schematically a section through a ribbon lap machine taken substantially along the line I—I of FIG. 2.

Describing now the drawings, it is to be understood that only enough of the construction of the apparatus for doubling fiber webs has been illustrated in the drawings as needed for those skilled in the art to readily understand the underlying principles and concepts of the present development, while simplifying the showing of the drawings. Turning attention now specifically to FIG. 1 there will be recognized a ribbon lap unit 1 which comprises two driven rotatable support shafts 2 for receiving and supporting thereupon a lap 3. Following the two rotatable support shafts 2, as seen in the direction of transport or conveying of the web 8 outfed from the lap 3, is a web transport means 4, a web diverter 5, a diverter plate arrangement 6 and a web collecting or collector element 7.

Due to the rotation of the support shafts 2 the lap 3 is rotated in the direction of rotation R and thus delivers the web 8 which is further guided in the web transport means 4 and thereafter passes then over the web diverter or web diverting mechanism 5 and over the diverter plate arrangement 6 onto the web collecting element 7 located therebelow.

Figure 2:
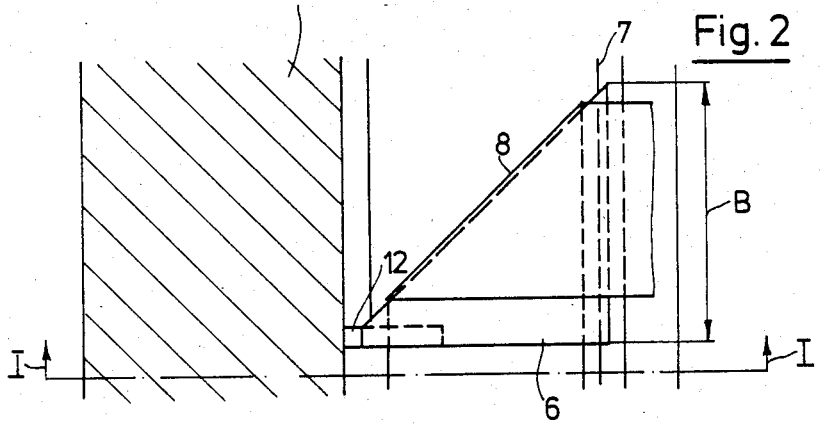
FIG. 2 is a top plan view, in section and illustrated partially schematically, of the ribbon lap machine depicted in FIG. 1, taken substantially along the line II—II thereof.

The diverter plate arrangement 6 diverts or turns in conventional manner the web 8 delivered by the web transport means 4 so as to assume a web transport direction which is rotated through approximately 90° relative to the transport direction of the web transport means 4, as the same has been illustrated in FIGS. 1, 2 and 3.

Figure 5:
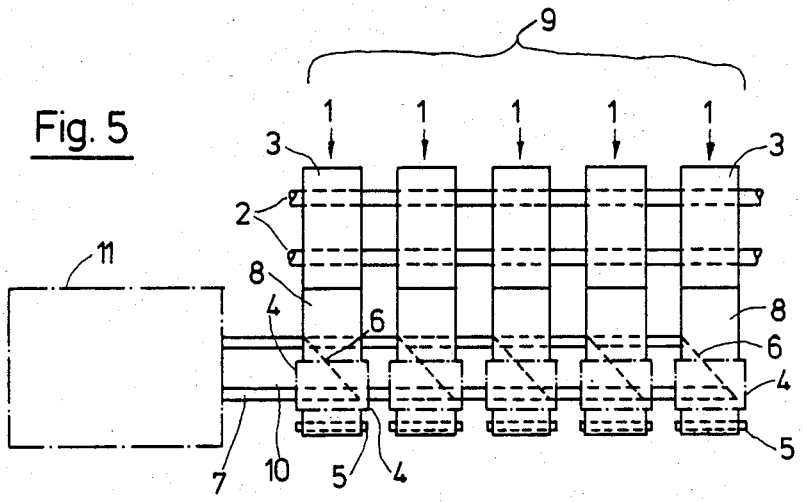
FIG. 5 illustrates on a reduced scale and partially schematically a top plan view of the ribbon lap machine illustrated in FIG. 1.

Upon the web collecting element 7 there are superposed or laid upon one another all of the webs 8 of the individual ribbon lap units 1 which are combined together to form a ribbon lap machine 9, as shown in FIG. 5, and these superposed webs 8 are taken up in the form of a fiber layer 10 by a suitable lap winding apparatus 11.

The web collecting or collector element 7 may be constituted by a conventional polished brass plate, but it also can be designed as a conveyor belt or band.

The web transport means 4 comprises a conventional drafting mechanism for webs, wherein, in the showing of FIG. 1, the not particularly designated pairs of rollers have been indicated with dotted lines. Such drafting mechanisms are well known in the textile art and since the details thereof are not essential to the underlying concepts of the invention no further description is here given regarding the same. This is also true as applies to the rotatable support shafts 2 and their related standard drive mechanisms or drives.

The diverter plate arrangement 6 is secured by means of a support or carrier member 12 to the machine frame 13, as best seen by referring to FIGS. 1 and 2. This diverter plate arrangment 6 is arranged beneath the web transport means 4 in such a manner that it is located within the machine frame 13, and specifically such that the web diverter or web diverter mechanism 5 projects further into the space or region on the service side of the machine than the diverter plate arrangement 6. The web diverter 5 is also secured by suitable supports or carrier members 14 to the machine frame 13.

Turning attention now for the moment to FIGS. 8*a* to 8*m* there have been illustrated therein various exemplary embodiments of web diverting devices or web diverters.

Specifically, in FIGS. 8*a* to 8*g* and FIGS. 8*k* to 8*m* there have been depicted stationary web diverters 5.1 to 5.7 and 5.10 to 5.12, respectively, over which a related web 8 slides.

FIGS. 8*h* and 8*i* respectively show web diverters 5.8 and 5.9 which are rotatably supported in roller bearings 15 and 16, respectively. In the case of the web diverter 5.8 of FIG. 8*h* the same is driven by the web 8, whereas in the case of the web diverter 5.9 of FIG. 8*i* the latter is driven by means of a suitable drive such as a drive gear 17, by way of example. The conventional drive unit for powering this drive gear 17 has not been particularly shown, but the same may be constituted, for instance, by a standard toothed belt which is driven in the machine frame 13.

In the showing of FIGS. 8*a* to 8*m* the web 8 has been conveniently indicated by dotted lines, and specifically there has been depicted by the illustrated profiles or sectional shapes of such webs 8 the form and nature of the web diversion or deflection.

In the case of the web diverters 5.1 (FIG. 8*a*), 5.6 (FIG. 8*f*), 5.7 (FIG. 8*g*), 5.8 (FIG. 8*h*) and 5.9 (FIG. 8*i*) it will be observed that each of them have an enlarged or extended guide surface 5*a*, and it is to be understood that the term "guide surface" refers to that surface upon which the related web 8 is slideably guided. By virtue of the concavely curved guide surfaces 5*b* of the web diverters 5.2 (FIG. 8*b*) and 5.10 (FIG. 8*k*), respectively, and equally by virtue of the concavely bent guide surface 5*c* of the web diverter 5.4 (FIG. 8*d*), the web 8 is made narrower during the web diversion or deflecting operation, whereas the web 8 is broadened during its guidance over the convexly curved guide surface 5*d* of the web diverter rollers 5.3 (FIG. 8*c*) and 5.11 (FIG. 8*h*) and over the convexly bent guide surface 5*e* of the web diverter 5.5 (FIG. 8*e*).

The guide surfaces 5*a*, 5*b* and 5*d* of the web diverters 5.6, 5.10 and 5.11, respectively, which are inclined in one direction relative to the plane in which the web 8 is delivered, serve to reorient the related web, in other words, selectively serve to reorient the corresponding web in the direction of the side of the diverter plate arrangement 6 which is curved with the radius r or corresponding to the other side of the diverter plate arrangement 6 lying opposite the side having the radius r.

Figure 7:
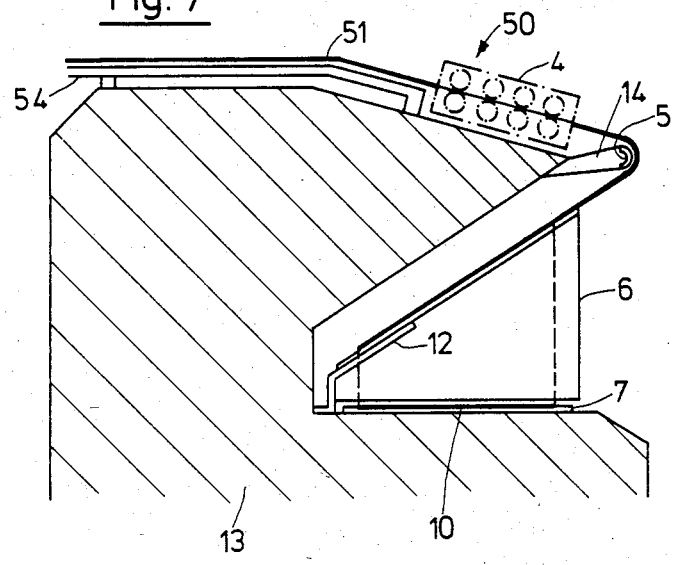
FIG. 7 is a sectional view through the sliver lap machine of FIG. 6, taken along the line IV—IV thereof and shown on an enlarged scale and partially schematically.
Figure 4:
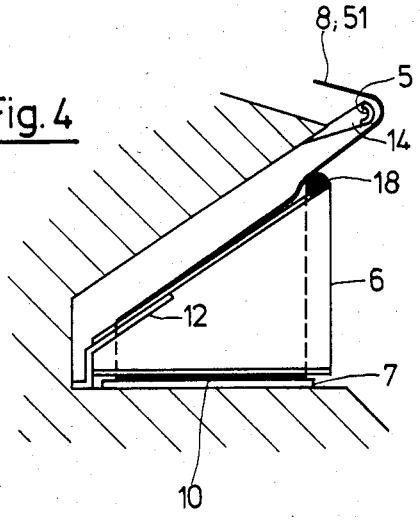
FIG. 4 is a sectional view, similar to the showing of FIG. 1, depicting a modification of a detail of the ribbon lap machine depicted in FIG. 1.

The web diverters 5.1 to 5.6 and 5.10 and 5.12 are constituted by substantially U-shaped curved plates as shown in FIGS. 1, 4 and 7, whereas the web diverters 5.7, 5.8 and 5.9 have a substantially rounded bar-shaped configuration. Finally, the trough-shaped web diverter 5.12 serves for the simultaneous sideways guiding of the web 8 during its web diversion or deflection.

The web diverters 5 may possess a smoothly polished surface or a roughened surface, such as a so-called orange-skin surface.

The web transport means 4, the web diverter 5, the diverter plate arrangement 6 and the web collector or collecting element 7 are referred to collectively as an "apparatus for doubling of webs". The use of this apparatus in connection with the assembly of individual sliver lap machine units 50 (FIG. 7) into a sliver lap machine 53 has been illustrated in FIG. 6.

The difference in relation to the heretofore described ribbon lap machine, among other things, resides in the fact that the web 51 is formed from fiber slivers taken from sliver cans 52 and is fed during this formation upon a feed table 54 (only illustrated in FIG. 7) to the web transport means 4, again for instance, constituted by a standard drafting mechanism.

The further travel of the web 51 corresponds to that of the web 8 of the ribbon lap machine previously described with reference to FIGS. 1 to 3 and 5, in other words the drawn webs 51 are finally guided together to form a fiber layer 10 and taken-up by a lap winding apparatus 11. Accordingly, in the arrangement of FIG. 6 there have been generally used the same reference characters to denote the same or analogous components as employed with respect to the arrangement of FIGS. 1 to 3 and 5. Furthermore, it is to be understood that for simplicity in the description the same or analogous elements or components previously described will not be here again described.

Figure 6:
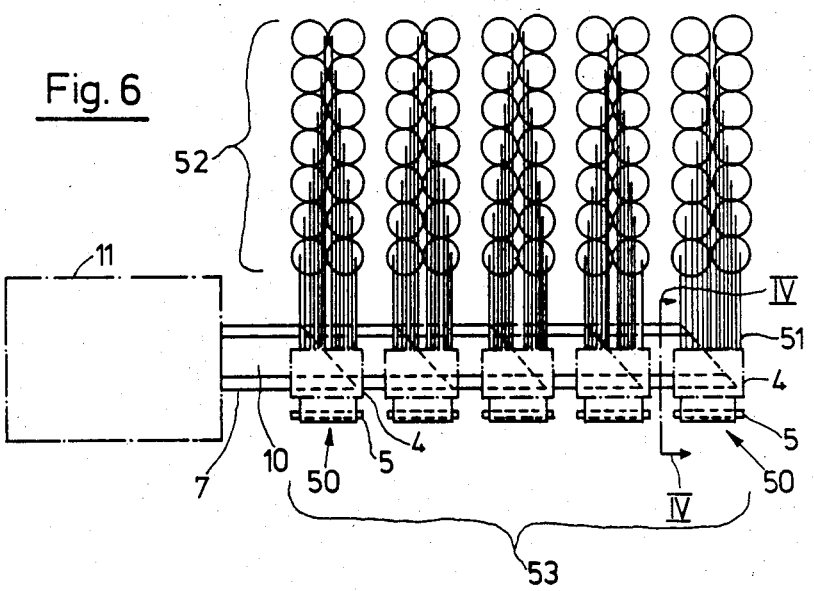
FIG. 6 illustrates in the same scale as in the arrangement of FIG. 5 a top plan view of a sliver lap machine.

Finally, FIG. 4 illustrates a modification which can be used in connection with the ribbon lap machine depicted in FIG. 5 and the sliver lap machine depicted in FIG. 6. This modification concerns the web guide 18 which, as clearly shown by inspecting FIG. 4, is provided at the starting region or portion of the diverter plate arrangement 6 and extends over the complete width B (FIG. 2) of such diverter plate arrangement 6.

This web guide 18 can have imparted thereto the shapes illustrated in FIGS. **8*b* to 8*f* and 8*k* to 8*m*, so that by virtue of this web guide 18 there can be assisted the web guiding action exerted by the web diverter 5 assuming a similar form or design for the web diverters 5**.

While there are shown and described present preferred embodiments of the invention, it is to be distinctly understood that the invention is not limited thereto, but may be otherwise variously embodied and practiced within the scope of the following claims.

Accordingly, what we claim is:

1. An apparatus for doubling webs comprising:

web transport means for transporting a web in a first predetermined transport direction;

a web collecting element for collecting the web delivered by the web transport means and for guiding such for movement in a second predetermined transport direction;

a diverter plate arrangement disposed between said web transport means and said web collecting element for diverting the web from the first predetermined transport direction of the web transport means into the second predetermined transport direction of the web collecting element;

a web diverter arranged between the web transport means and the diverter plate arrangement; and said diverter plate arrangement being located substantially directly below the web transport means.

2. The apparatus as defined in claim 1, wherein:

said web transport means comprises a drafting mechanism for webs.

3. The apparatus as defined in claim 2, wherein:

said drafting mechanism processes a homogeneous web.

4. The apparatus as defined in claim 2, wherein:

said drafting mechanism processes fiber slivers guided adjacent one another.

5. The apparatus as defined in claim 1, wherein:

said web diverter possesses a stretched guide surface.

6. The apparatus as defined in claim 1, wherein:

said web diverter possesses a curved guide surface.

7. The apparatus as defined in claim 1 wherein:

said web diverter possesses a bent guide surface.

8. The apparatus as defined in claim 1, wherein:

said web diverter possesses a substantially trough-shaped guide surface.

9. The apparatus as defined in claim 1, wherein:

said diverter plate arrangement containing one side which is curved at a predetermined radius of curvature, and an other side which is opposite to said one side; and said web diverter being inclined in a predetermined direction to either said one side or said other side of said diverter plate arrangement and relative to a plane in which the web is delivered.

10. The apparatus as defined in claim 1, wherein:

said web diverter possesses a substantially bar-shaped configuration.

11. The apparatus as defined in claim 1, wherein:

said web diverter is structured to provide sliding guidance for the web.

12. The apparatus as defined in claim 10, wherein:

said substantially bar-shaped web diverter comprises a movable web guide structure.

13. The apparatus as defined in claim 12, wherein:

said web diverter comprises a driven web diverter defining said movable web guide structure.

14. The apparatus as defined in claim 1, wherein:

said web diverter possesses a smoothly polished surface.

15. The apparatus as defined in claim 1, wherein:

said web diverter possesses a roughened surface.

16. The apparatus as defined in claim 15, wherein:

said roughened surface of said web diverter constitutes an orange-skin surface.

17. The apparatus as defined in claim 1, wherein:

said doubling apparatus is used in a sliver lap machine; and the web fed to the web transport means comprises drawn staple fiber slivers.

18. The apparatus as defined in claim 1, wherein:

said doubling apparatus is used in a ribbon lap machine; and the web fed to the web transport means is delivered from a lap.

19. The apparatus as defined in claim 1, wherein:

said second predetermined transport direction of said web collecting means extends substantially at 90° relative to said first predetermined transport direction of said web transport means.

* * * * *